United States Patent [19]

Ripoll et al.

[11] Patent Number: 4,485,924

[45] Date of Patent: Dec. 4, 1984

[54] SQUARE STACKABLE AND PALLETIZABLE DRUM

[76] Inventors: Angel Ripoll, C/Parque, 27-Cartagena (Murcia); Antonio Vidal, Pza. Caudillo, 15-Sedavi (Valencia), both of Spain

[21] Appl. No.: 401,841

[22] Filed: Jul. 26, 1982

Related U.S. Application Data

[63] Continuation-in-part of Ser. No. 134,872, Mar. 28, 1980, abandoned.

[30] Foreign Application Priority Data

Feb. 4, 1980 [ES] Spain ..... 248326

[51] Int. Cl.[3] ..... B65D 21/02

[52] U.S. Cl. ..... 206/511; 206/508; 220/1.5; 222/143

[58] Field of Search ..... 206/503, 508, 509, 511, 206/512; 220/1.5, 257, DIG. 1; 222/143

[56] References Cited

U.S. PATENT DOCUMENTS

| | | | |
|---|---|---|---|
| 1,441,674 | 1/1923 | Foster | 220/DIG. 1 |
| 1,746,332 | 2/1930 | Barroll | 206/509 |
| 1,891,033 | 12/1932 | Wackman | 220/257 |
| 1,910,410 | 5/1933 | Shera | 220/257 |
| 2,010,535 | 6/1935 | Cooper | 220/257 |
| 2,156,540 | 5/1939 | Melrath | 220/257 |
| 2,310,420 | 2/1943 | Graham | 206/508 |
| 3,130,855 | 4/1964 | Gunn | 220/1.5 |
| 3,387,749 | 6/1968 | Godshalk | 222/143 |
| 3,547,299 | 12/1970 | Kapple | 206/503 |

FOREIGN PATENT DOCUMENTS

| | | | |
|---|---|---|---|
| 1297050 | 11/1976 | United Kingdom | 206/509 |

*Primary Examiner*—George E. Lowrance

*Attorney, Agent, or Firm*—Ostrolenk, Faber, Gerb & Soffen

[57] ABSTRACT

A stackable drum as disclosed. At one edge of the top, a water collecting channel is defined having outlet holes communicating with it. The walls of the drum are reinforced. A skirting on the bottom of the drum is received within the lip of the drum beneath. The top, bottom and side walls are adapted to cooperate, when a plurality of such drums are stacked vertically, to pass the weight of an upper drum directly through the rim of the top, through the walls and bottom, and into a third drum stacked below it. A cap seal is applied atop the lid of the drum. It is in the form of a closed pan, with a stopper in it.

10 Claims, 12 Drawing Figures

FIG. 2.
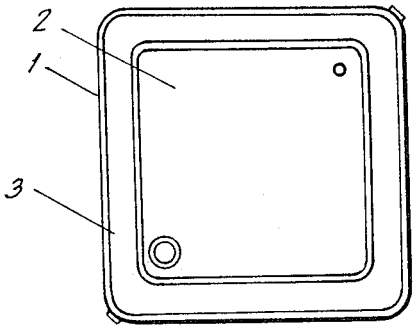
FIG. 4.
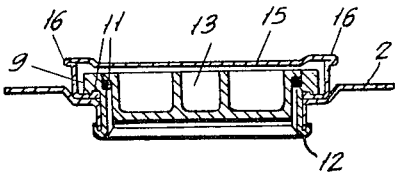
FIG. 5.
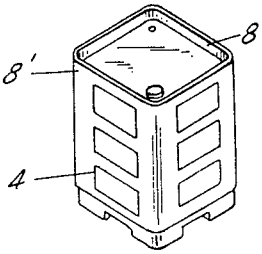
FIG. 1.
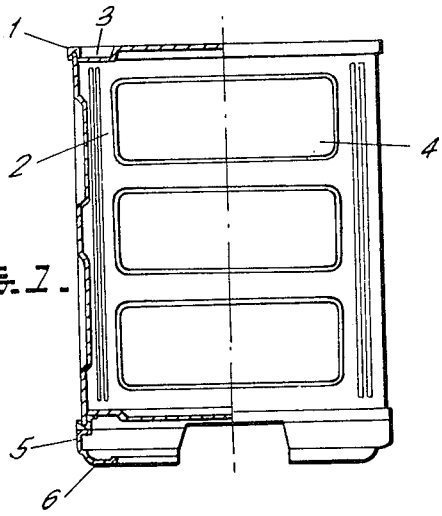
FIG. 6.
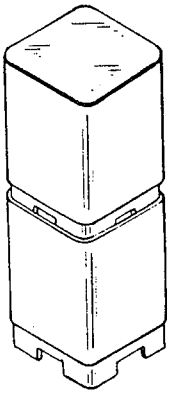
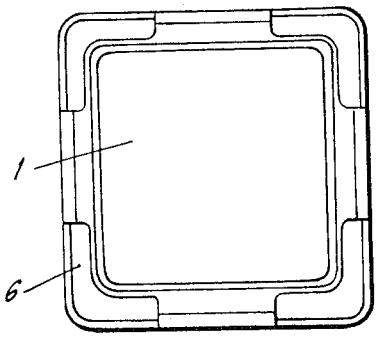
FIG. 3.

FIG. 7
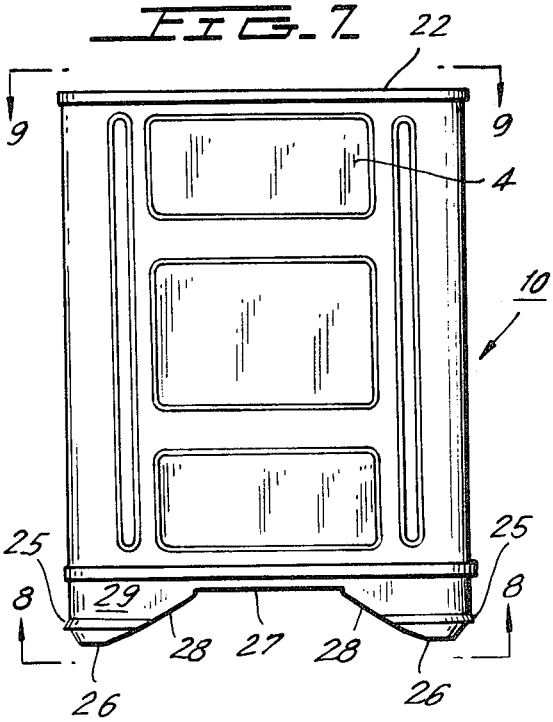
FIG. 10
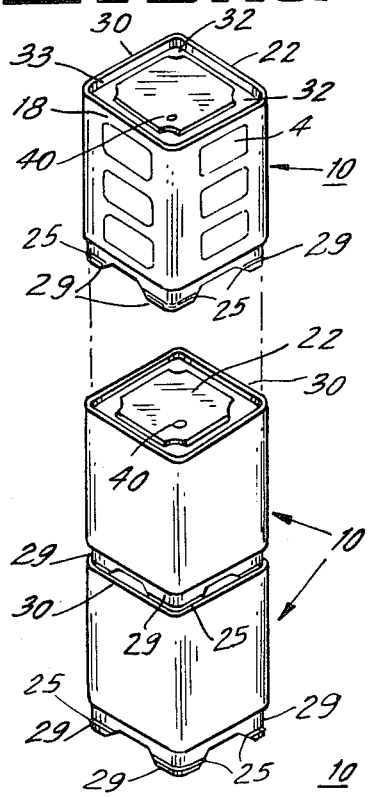
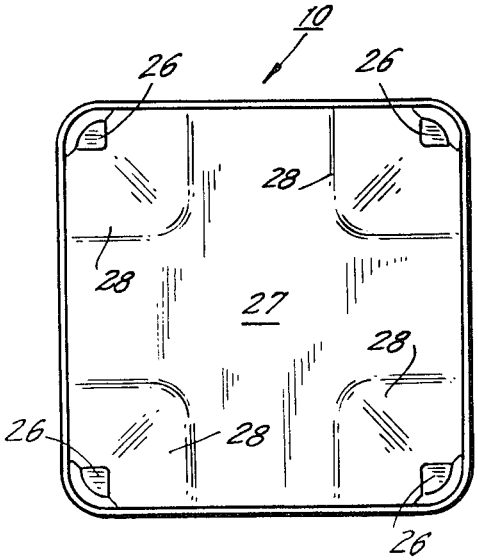
FIG. 8
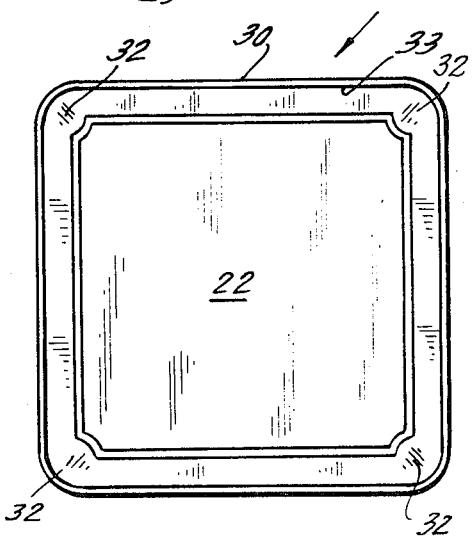
FIG. 9

SQUARE STACKABLE AND PALLETIZABLE DRUM

This is a continuation-in-part of pending application Ser. No. 134,872, filed Mar. 28, 1980 now abandoned.

The present invention relates to a square stackable and palletizable drum with rounded edges and bases, adapted to receive the weight of the upper drum and to provide a support for the lower drum.

The present applicants are the owners of Spanish Utility Model No. 241,877, in which a stackable square drum was disclosed, whose base had holes to allow the passage of the prongs of fork lifts provided with beveled ends, in the jambs, and with a lintel in an inclined plane for displacing the center of gravity towards the geometric center of the load assembly, which enabled the usual load platforms, or four-element pallets, to be dispensed with, and assisted the prongs of the fork lift to enter and leave the holes, avoiding the possibility of their unexpectedly getting snagged or dragged.

However, the structure of the drum disclosed in the previous Utility Model mentioned above had an upper lid in which the perimetral bourdon, or rim, remained under the support step which held the weight of a second drum placed on top of it, whereby the weight load was applied in the lid in such a way as to create the risk of denting the lid under the strain of the weight above it. Moreover, the actual shape of the lid at the top and the supports in the base formed rectilinear projections and steps which allowed little play in fitting the base of the drum into the top of another to stack them.

As has been observed with conventional cylindrical containers, due to their special rib characteristic and flat lid, when they are stored outdoors in a stack, rainwater collects on the lid and, once it reaches the rib, drips down onto all the lower drums below, produces filtrations which pollute the contents of the lower drums despite their being fully sealed, producing damage to the contents which results in losses and discredit in the trade.

The following solution of the problem has been developed: lifting the perimetral bourdon, forming a channel parallel to the perimeter, making drainage holes in the outer wall of this channel and ensuring that the support points of the lower base of each drum are provided with a step made by skirting in line with the vertical faces of the drum so aligned relative to the edge of the bourdon that the weight of each drum in a stack of drums of this type passes directly through the vertical faces of the drum below it. Moreover, the base of each drum is provided with curved outer corners so that drum fits easily but precisely into the lid of another self-centering drum by piling them one on top of the other. The base is high enough to leave a sufficient space between vertically adjacent drums to permit lifting the sealing lid and wrap with cap binding as described in detail below.

Further objects and explanations of the scope of this invention will be found in the following description and drawings of preferred embodiments thereof set forth by way of example and without limiting the scope of the invention.

FIG. 1 is an elevation of the drum of the present invention;

FIG. 2 is a top plan view of the drum of the present invention showing its cover;

FIG. 3 is a bottom view of the drum of the present invention showing its base;

FIG. 4 is a cross-sectional view through the cover of FIG. 2;

FIG. 5 is a view in perspective of the drum of FIGS. 1–4 showing the drainage openings;

FIG. 6 is a view in perspective showing the stackability of the drums of FIGS. 1–5;

FIG. 7 is a front elevation showing a modified and preferred form of the drum of FIGS. 1–6;

FIG. 8 is a bottom view of the drum of FIG. 7 taken from lines 8—8 of FIG. 7 looking upwardly in the direction of the arrows;

FIG. 9 is a top view of the drum of FIG. 7 taken from line 9—9 of FIG. 7 looking down in the direction of the arrows; and FIG. 10 is a view in perspective showing the stacking and drainage arrangement of the drums of FIGS. 7–9.

Figure 11:
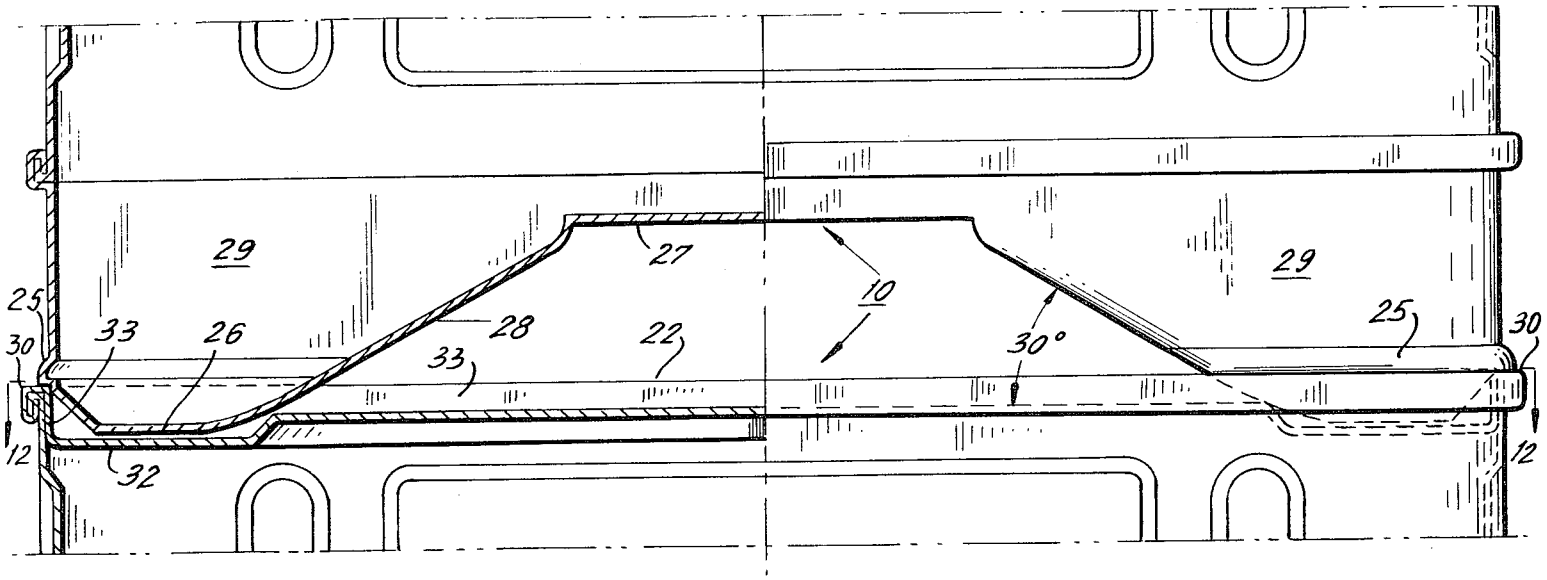
FIG. 11 is a partial elevation of two containers, one resting on the other.
Figure 12:
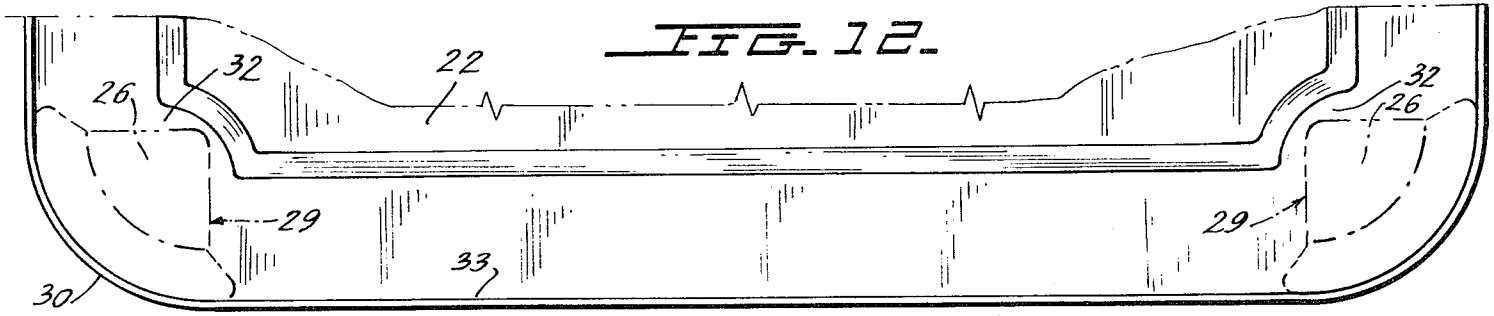
FIG. 12 is a view taken from line 12—12 of FIG. 11, showing the top of the lower container.

Referring to the drawings, the raised perimetral bourdon 1 defines the rim of the drum lid 2. A channel 3 immediately inside of the bourdon 1 will collect rainwater or any other liquid which may fall on the drums; passing holes 8 which are made throughout the outer wall in any desired number permit drainage.

Due to the fact that when several such drums are stacked vertically the load is transmitted by the vertical walls of each drum, it is advisable to reinforce their surface by means of reinforcements 4 which prevent sags and strains. To ensure that when the base of one drum is placed in the bourdon 1 of the drum below it, whereby the supports placed in the same bourdon 1 transmit the loads, so that the loads are transmitted downwardly directly through the drum walls, a skirting 5 is arranged in the lower part 7 of the drum which defines a step and will so engage the bourdon 1 of the next lower drum as to pass the load directly through the walls. The base 7 also has its corner feet 6 which are curved and which will provide for self-centering in the channel 3 of the next lower drum.

Due to the raising of these feet 6 and to skirting 5, a vertical spacing is created between each two drums in the pile of drums, which spacing allows the lid to be lifted and allows use of a very effective cap seal that is impossible to force open. A thread box 9 is inserted in a round hole in the lid 2, and is held by the flanged edge 12 in the hole. It is inserted by being pressed onto the step 17 by means of an airtight joint 11 and the lower border 12 of the sealing pan is flanged, becoming firmly secured. Once the seal basin has been formed, the stopper 13 can be screwed into the box 9, which also has an airtight joint 11. Finally the lid 5 is put in place and is then flanged throughout its perimeter 16, creating a completely enclosed pan, sealed and raised to prevent any foreign body entering, achieving absolute airtightness which avoids the necessity of resealing again, as the drum lid, the thread box and the cap base of the seal form a strongly joined assembly.

In FIGS. 7, 8, 9 and 10 there is shown a modified form of the structure of FIGS. 2–6 in which the drum 10 is provided with the same type of reinforcements 4 as described in connection with the drum of FIGS. 1–6 but wherein the support members which are used for stacking are differently arranged. It will be noted that the support members 26 are spaced from each other by an opening 27 which is much wider than the openings provided between the support member 6 of the drums of FIGS. 1–6. In addition, the slanting at 28 of the side wall 29 of the lower peripheral end of the drum which forms a stand for the drum 10 provides freer access to the lid 40 of the drum 10. The additional wall or platform member 29 is provided with the skirt 25 which is so arranged that as seen in the stacked elements of FIG. 10, rests on the ledge 30 of the drum which surrounds the opening which is covered by the cover member 22. It will be noted that the cover member 22 is recessed to provide access for the support member 26 to the top cover member 22.

The cover member 22 is notched at 32 to provide appropriate space for the feet 26, while the skirt 25 rests on the upper surface 30 of the extension of the side of the drum at the upper end. The opening in the drum which is covered by the cover member 22 is not shown but it is sufficient to say that the cover member 22 secures the top of the drum and cooperates in provides positioning and spacing for the legs 26.

The requirement for such positioning and spacing is obvious from a comparison of FIG. 8 with the top of FIG. 10 showing that the legs 26 must have sufficient room in order to obtain good support on the cover member of the drum 10. The drum of FIGS. 7–10 has a top structure which corresponds to the similar section 3 of the top wall of the drum of FIGS. 1–7 and provides an area for the collection of rainwater as well as means indicated generally in the area 18 of the ledge 30 such as openings to permit drainage. As already pointed out, the utilization of the feet 26 in the skirting 25 permits a vertical spacing between the drums when they are stacked, as shown in FIG. 7, to thereby permit the use of an effective lid 40 which may readily become accessible owing to the additional spacing 27 provided in the drum of FIGS. 7–10. This allows the lid 40 to be lifted and even allows for the utilization of an effective lid 40.

In the foregoing, the present invention has been described in connection with preferred illustrative embodiments thereof. Since many variations and modifications of the invention will now be obvious to those skilled in the art, it is preferred that the scope of this invention be determined not by the specific disclosures herein contained, but only by the appended claims.

What is claimed is:

1. A stackable palletizable, rectangular drum, comprising:

a rectangular top having an upraised perimetral rim around the drum, said rectangular rim having corners each of which is curvedly rounded;

said top is formed with a drainage channel immediately inward from said rim;

a base portion at the bottom of said drum and adapted to be received just inside said upraised rim of an identical drum when a plurality of said drums are stacked vertically on top of each other; said base portion of said drum comprising a respective support foot at each said corner of said base portion and also extending away from the respective said corner a distance toward the feet at the adjacent corners, while said foot is spaced from the feet at the adjacent corners; each said foot being curved correspondingly to the respective said corners of said rim;

each said foot including on it a peripheral edge portion which is a horizontal surface that is outwardly directed from said foot and also spaced from the bottom of said foot a distance, for applying force directly down upon and such that each said peripheral edge portion at each said corner is adapted to pass the load of said drum through to the said rim at the corners of another said drum on which said drum is stacked; each said foot including a section that is located inwardly of said rim of said other drum below and that is inward of and extends beneath said horizontal surface of that said foot; the corresponding curvatures of said feet and said rims of vertically adjacent drums provides for centering of said drums and for passage of the load of an upper drum through said corners of said drum below;

said drainage channel being of such width inward of said rim and of such depth and said foot being of such height and said horizontal surface being so placed along the height of said foot that said horizontal surface of said feet of one of said drum may rest on the said rim beneath while the parts of said feet below said horizontal surfaces do not extend down far enough to rest on the top of the said drum beneath; and a side wall surface; said rim being an extension up from said wall surface; said base portion feet being an extension down from said side wall surface, said rim and said base portion being adapted to cooperate, when a plurality of said drums are stacked vertically on top of each other, in such a manner as to pass the weight of yet another said drum on top of said drum through said rim, directly into and through said side wall surface, through said base portion and said peripheral edge portion to said rim of another said drum on which said drum is stacked.

2. The drum of claim 1, wherein said side wall surface is formed with a plurality of reinforcements to improve its mechanical strength.

3. The drum of claim 1, wherein said rim is provided with a plurality of drainage holes for draining fluid from said drainage channel.

4. The drum of claim 1, wherein said base portion and said rim are of a height and said peripheral edge portions of said feet are at a height along said feet adapted to provide a vertical spacing above the top of another identical drum when a plurality of such drums are stacked vertically to permit access to the top of the lower said drum between the feet of said drum without removing said drum from on the lower drum.

5. The drum of claim 4, wherein said top includes a lid which is adapted to be opened when an identical drum is stacked on top of said drum, without removing the upper drum.

6. The drum of claim 4, wherein said lid further comprises a protruding seal.

7. The drum of claim 6, wherein said top has a hole formed therein receiving said seal, and wherein said lid comprises a box received securely in said hole, a stopper screwed into said box, and a cap securely flanged on said box, said lid including a portion which is held securely between said box and the remainder of said top of said drum when said seal is in place.

8. The drum of claim 4, wherein said peripheral edge portion comprises a respective outwardly projecting skirt on each said foot and having said horizontal surface beneath it for resting upon said rim of said drum below it.

9. The drum of claim 1, wherein said peripheral edge portion comprises a respective outwardly projecting skirt on each said foot and having said horizontal surface beneath it for resting upon said rim of said drum below it.

10. The drum of claim 1, wherein the said upraised rim is of uniform height around said drum.

* * * * *